US007174001B2

(12) United States Patent
Andrews et al.

(10) Patent No.: US 7,174,001 B2
(45) Date of Patent: Feb. 6, 2007

(54) INTEGRATED FLUID PUMP FOR USE IN AN X-RAY TUBE

(75) Inventors: Gregory C. Andrews, Draper, UT (US); Bradley Dee Canfield, Orem, UT (US)

(73) Assignee: Varian Medical Systems Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/937,132

(22) Filed: Sep. 9, 2004

(65) Prior Publication Data

US 2006/0050852 A1 Mar. 9, 2006

(51) Int. Cl.
*H01J 35/10* (2006.01)

(52) U.S. Cl. ..... 378/141; 378/199; 378/200

(58) Field of Classification Search ..... 378/199, 378/200–202, 119, 121, 122, 125–130, 141
See application file for complete search history.

(56) References Cited

U.S. PATENT DOCUMENTS 2,040,441 A * 5/1936 McEuen ..... 378/141
2,170,933 A * 8/1939 Werner ..... 378/202
2,259,037 A * 10/1941 Graves ..... 378/200
2,611,095 A * 9/1952 Goldfield et al. ..... 378/202
4,264,818 A * 4/1981 Petersen ..... 378/141
4,384,360 A * 5/1983 Kitadate et al. ..... 378/202
5,357,555 A * 10/1994 Gerth ..... 378/200
6,320,936 B1 * 11/2001 Holland et al. ..... 378/140
2005/0147208 A1 * 7/2005 Kendall et al. ..... 378/141

* cited by examiner

*Primary Examiner*—Edward J. Glick
*Assistant Examiner*—Jurie Yun
(74) *Attorney, Agent, or Firm*—Workman Nydegger

(57) ABSTRACT

An integrated fluid pump for use in circulating a coolant in an x-ray tube is disclosed. The pump includes a pump body, a pump head, and a motor. The pump head defines a pump volume and further includes a fluid inlet, a fluid outlet, and an impeller positioned in the pump volume that is rotatably driven by the motor to receive coolant from the fluid inlet and eject the fluid via the fluid outlet. The pump is structurally integrated with an outer housing of the x-ray tube, the outer housing containing the coolant. In one embodiment, the fluid inlet and a portion of the pump volume are defined by a portion of the outer housing of the x-ray tube. This integration makes the structural completeness of the fluid pump dependent on the outer housing or other suitable x-ray tube component.

11 Claims, 5 Drawing Sheets

INTEGRATED FLUID PUMP FOR USE IN AN X-RAY TUBE

BACKGROUND

1. Technology Field

The present invention generally relates to x-ray generating devices. In particular, the present invention relates to an integrated fluid pump that simplifies tube design while enhancing replacement options when replacement of pump components is required.

2. The Related Technology

X-ray producing devices, such as x-ray tubes, are extremely valuable tools that are used in a wide variety of applications, both industrial and medical. For example, such equipment is commonly employed in areas such as medical diagnostic examination and therapeutic radiology, semiconductor manufacture and fabrication, and materials analysis.

Regardless of the applications in which they are employed, x-ray tubes operate in similar fashion. In general, x-rays are produced when electrons are emitted, accelerated, and then impinged upon a material of a particular composition. This process typically takes place within an evacuated enclosure of the x-ray tube. Disposed within the evacuated enclosure is a cathode, or electron source, and an anode oriented to receive electrons emitted by the cathode. The anode can be stationary within the tube, or can be in the form of a rotating annular disk that is mounted to a rotor shaft which, in turn, is rotatably supported by a bearing assembly. The evacuated enclosure is typically contained within an outer housing, which also serves as a reservoir for a coolant, such as dielectric oil, that serves both to cool the x-ray tube and to provide electrical isolation between the tube and the outer housing.

In operation, an electric current is supplied to a filament portion of the cathode, which causes a cloud of electrons to be emitted via a process known as thermionic emission. A high voltage potential is placed between the cathode and anode to cause the cloud of electrons to form a stream and accelerate toward a focal spot disposed on a target surface of the anode. Upon striking the target surface, some of the kinetic energy of the electrons is released in the form of electromagnetic radiation of very high frequency, i.e., x-rays. The specific frequency of the x-rays produced depends in large part on the type of material used to form the anode target surface. Target surface materials with high atomic numbers ("Z numbers") are typically employed. The target surface of the anode is oriented so that the x-rays are emitted as a beam through windows defined in the evacuated enclosure and the outer housing. The emitted x-ray beam is then directed toward an x-ray subject, such as a medical patient, so as to produce an x-ray image.

Generally, only a small portion of the energy carried by the electrons striking the target surface of the anode is converted to x-rays. The majority of the energy is instead released as heat. It is important to remove as much of the excess heat produced during x-ray production so as to prevent heat related failures in the x-ray tube and its components. One common technique for removing heat is to submerge the evacuated enclosure in a coolant contained within the volume defined by the outer housing. The coolant absorbs heat from surfaces of the evacuated enclosure during tube operation.

Under certain circumstances, the ambient placement of a coolant about the evacuated enclosure by itself may not adequately cool the evacuated enclosure. For example, the coolant, such as a dielectric oil or similar medium, may stagnate or thermally pool in certain areas of the outer housing volume, thereby preventing adequate cooling to occur. One area of an x-ray tube that is prone to this phenomenon is located between the adjacent x-ray transmissive windows of the evacuated enclosure and outer housing. Thermal pooling in this region can cause extreme heating of the localized coolant, resulting in intermittent boiling of the coolant. This can result in the creation air bubbles within the coolant and thereby adversely affect the quality of the images produced by the x-ray tube.

To avoid such problems, x-ray tubes often circulate the coolant to prevent thermal pooling and to optimize heat transfer. For example, a fluid pump can be used to circulate the coolant within the outer housing volume. In other implementations the heated fluid can be extracted from the outer housing by the fluid pump and transferred to a heat exchange device, which cools the fluid before it is reintroduced into the outer housing volume. This type of arrangement provides a closed circulation cooling loop useful in removing excess heat from the x-ray tube and preventing problems associated with thermal pooling.

In some x-ray devices, the fluid pump is positioned a distance apart from the outer housing in an unattached configuration. In such a configuration, fluid communication between the outer housing and the fluid pump is achieved via fluid lines. Conversely, in other designs the fluid pump is attached as a complete unit directly to an exterior surface of the outer housing. In either configuration the fluid pump is a self-contained unit and is independently operable with respect to the x-ray tube. As such, should replacement of the fluid pump be necessary, the entire pump is removed, as a unit, from its unattached location or from the outer housing exterior. A new pump is then positioned in place of the previous pump and connected as needed.

X-ray tube cooling systems utilizing pump systems such as these, while functional, can be a relatively expensive option. For example, pump malfunction typically requires replacement or refitting of the entire fluid pump. This wholesale pump replacement occurs despite the fact that many components of the pump may not need to be replaced. Moreover, many such self-contained pumps include welded pump bodies. Should selective replacement of interior components in a welded pump be desired, it is first necessary to grind down or otherwise remove the welds in order access the interior components. After replacement of the components, re-welding must then occur. This process represents a significant expenditure of time and expense.

In light of the above, a need exists in the art wherein a coolant contained within the volume created by a housing of an x-ray tube can be effectively circulated by a fluid pump, so as to effect efficient cooling of x-ray tube components, such as the vacuum enclosure. Such circulation would preferably be accomplished via a fluid pump that has a simplified design and is integrated with the structure of the housing in a manner that reduces the need for complete pump replacement in the event of servicing and repair.

SUMMARY OF INVENTION EMBODIMENTS

The present invention has been developed in response to the above and other needs in the art. Briefly summarized, embodiments of the present invention are directed to a pump configuration that is capable of circulating a coolant within an x-ray tube device. The coolant, which in one embodiment is a dielectric oil, can be primarily contained within a reservoir defined by an outer housing portion of the x-ray tube. An evacuated enclosure that contains various tube components such as the anode and cathode, is disposed within the reservoir as to be at least partially enveloped by the coolant in a manner that allows the fluid to absorb heat from the evacuated enclosure during tube operation. Preferably, the pump functions to continuously circulate the coolant within a closed loop from the reservoir to a heat exchange device in order to remove the excess heat absorbed by the fluid during tube operation. The cooled fluid is then returned to the reservoir along the closed circulation loop to continuously remove heat.

In illustrated embodiments, the fluid pump is formed integrally with at least a portion of the outer housing, thereby minimizing both tube part count and production costs. In one embodiment, a fluid pump is presented having various components, including a pump body, a pump head, and a motor. Structural portions of one or more of these components are integrally formed with a portion of the structure of the outer housing. Hence, a structural component of the pump is completed by a structural portion of the outer housing. For example, in one embodiment a fluid inlet, a fluid outlet, and a portion of the pump head are defined by and integrally formed with the structure of the outer housing—such as a wall of the housing. This approach functionally integrates an aspect of the fluid pump with the structure of the outer housing and presents the pump and outer housing as a substantially singular and cohesive unit. In this example configuration, the outer housing cooperates with the integrated fluid pump to circulate coolant within the volume defined by the outer housing during tube operation, thereby insuring proper heat removal.

In another embodiment, a portion of the pump body of the fluid pump is formed from an extruded aluminum product. The pump body portion is then brazed to a portion of the outer housing that also functions to define a structural aspect of certain pump components, thereby completing the pump structure. Alternatively, the pump body is cast together with the outer housing to form a single unified structure.

In accordance with another embodiment, a fluid pump is positioned with respect to other tube components so as to increase operating efficiency. For example, in one embodiment the fluid pump is positioned substantially external to the outer housing. In another implementation, the fluid pump can be positioned within the fluid-filled reservoir defined by the outer housing, thereby preserving space. In yet another implementation, portions of the fluid pump can exist both within and external to reservoir defined by the outer housing. In any of these implementations, the fluid pump is structurally integrated with a portion of the outer housing in a dependent relationship.

In yet another example embodiment, an arrangement is disclosed that offers simplified replacement of pump components. In one embodiment, the pump body is integrated with the structure defined by the outer housing of the x-ray tube. As a low-wear component of the fluid pump, the pump body rarely requires replacement. Other pump components, however, such as the motor and the impeller do wear over time, and therefore need replacement or repair. Integration of the pump body with the outer housing enables pump components such as the motor and impeller to be replaced, while leaving the pump body intact. This obviates needless replacement of the pump body and associated components, thereby hastening replacement procedures during pump refurbishment, as well as reducing costs.

In one embodiment, the integrated fluid pump is a submerged pump type, wherein the components of the pump motor are in fluid communication with the coolant that passes through the pump volume. The flow of coolant within the motor assists in cooling the motor components, such as a stator. In other embodiments, however, partially submerged and non-submerged motors can be employed.

In one example embodiment, an x-ray tube comprising an evacuated enclosure containing an electron source and an anode positioned to receive electrons produced by the electron source is disclosed. Also disclosed is an outer housing defining an interior volume containing the evacuated enclosure and also adapted to contain a coolant for cooling the evacuated enclosure. A fluid pump that circulates the coolant is included and is implemented such that at least a structural portion of one pump component is formed integrally with a structural component portion defined by the outer housing—such as a housing wall. Moreover, the integral formation is accomplished in a manner such that the operation of the fluid pump is facilitated by way of its integration with the portion of the outer housing.

Thus, an integrated fluid pump as explained in the embodiments herein, offers a unique cooling solution for an x-ray tube while offering a simple design and enhanced fluid pump component replacement options.

These and other features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof that are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF SELECTED EMBODIMENTS

Reference will now be made to figures wherein like structures will be provided with like reference designations. It is understood that the drawings are diagrammatic and schematic representations of exemplary embodiments of the invention, and are not limiting of the present invention nor are they necessarily drawn to scale.

FIGS. 1–5 depict various example embodiments of the present invention, which is generally directed to an integrated fluid pump for use in cooling an x-ray tube. The fluid pump of embodiments of the present invention is implemented in a manner such that at least a portion of one or more structural components is formed integrally with a structural portion of the outer housing of the x-ray tube. In this way, implementation of a pump structure and its operation is dependent upon its integration with the outer housing structure. This pump configuration enables effective circulation of a coolant located within a reservoir defined by the outer housing. Preferably, circulation of the coolant occurs through a closed circulation cooling loop, which is in fluid communication with a heat removal device. This integrated pump design offers simplified structure and enhanced replacement options for the pump over the life of the x-ray generating apparatus.

As used herein, "fluid" and "coolant" is understood to encompass any one of a variety of substances that can be employed in cooling and/or electrically isolating an x-ray or similar device. Examples of fluid include, but are not limited to, de-ionized water, insulating liquids, dielectric oils and even non-liquid mediums. Further, it is appreciated that, while embodiments of the present invention described herein are concerned with integration of a fluid pump with a portion of an outer housing of an x-ray tube, other tube components can integrate with the fluid pump in order to complete its structure and functionality. Examples of such tube components include exterior tube shielding structures, and various components of a closed circulation cooling system, such as a heat exchanger. In addition, though the embodiments described herein relate to integration of a fluid pump with a rotary anode x-ray tube, tubes of other types, such as stationary anode x-ray tubes, can also benefit from the teachings of the invention.

Figure 1:
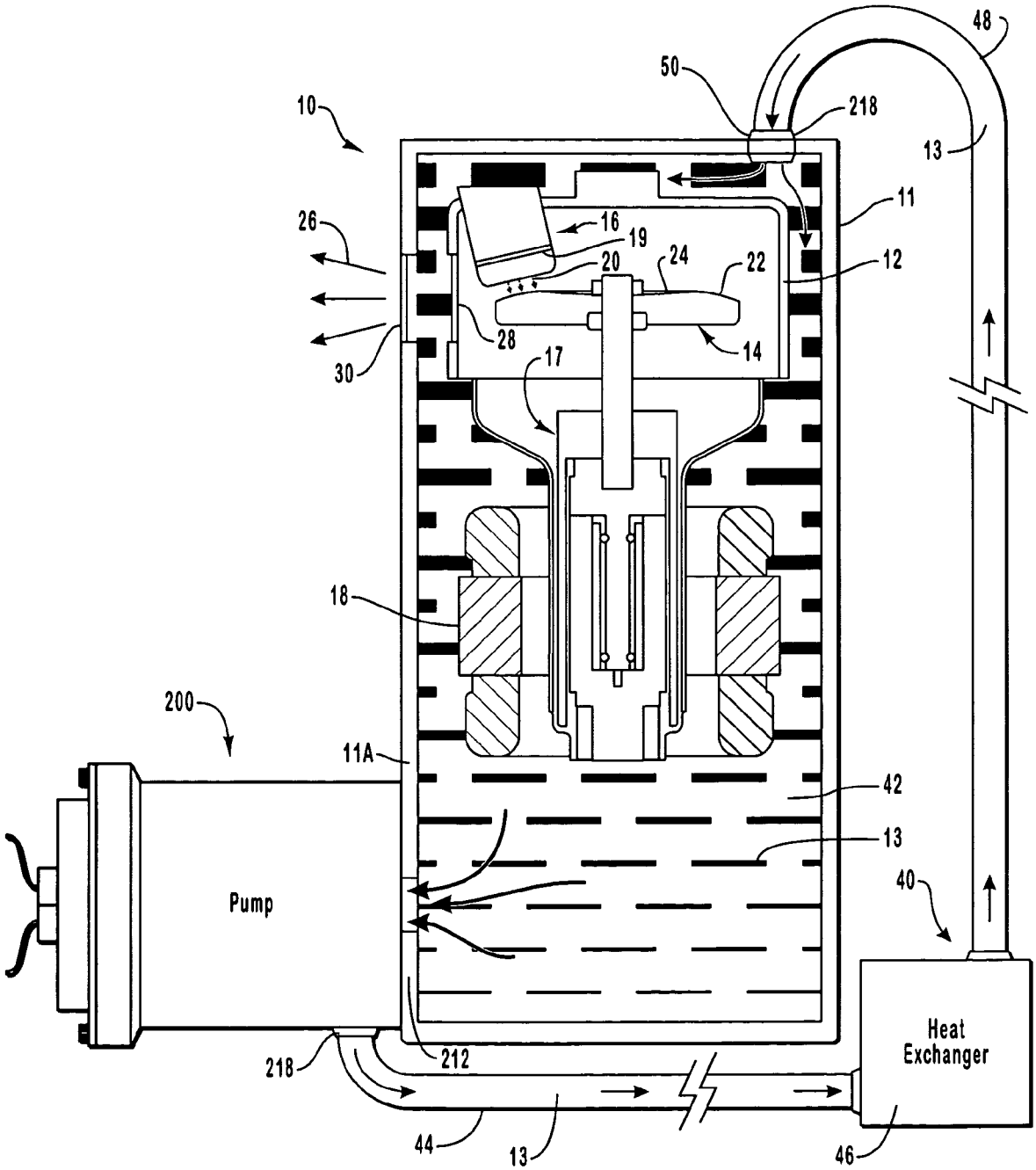
FIG. 1 is a simplified cross sectional depiction of an x-ray device incorporating a fluid pump according to one embodiment of the present invention.

Reference is first made to FIG. 1, which illustrates a simplified structure of a conventional rotating anode-type x-ray tube, designated generally at 10. X-ray tube 10 includes an outer housing 11, within which is positioned an evacuated enclosure 12. A coolant 13 is also disposed within an interior reservoir defined by the outer housing 11. The coolant envelops at least a portion of the evacuated enclosure 12 so as to assist in the cooling of the evacuated enclosure and the components contained therein. In addition, the coolant is typically a dielectric so as to provide electrical isolation between the evacuated enclosure and the outer housing. In one embodiment, the coolant 13 comprises a dielectric oil medium, which provides desirable thermal and electrical insulating properties. However, any one of a number of different coolant mediums could be utilized.

In the illustrated embodiment, there is positioned within the evacuated enclosure 12 a rotating anode 14 and a cathode 16. Here, the anode 14 is spaced apart from and oppositely disposed to the cathode 16, and is at least partially composed of a thermally conductive material such as copper or a molybdenum alloy—although other implementations could be utilized. In this embodiment, the anode 14 is rotatably supported by a rotor assembly 17. The rotor assembly 17 provides rotation of the anode 14 during tube operation via a rotational force provided by a stator 18.

The cathode 16 includes a filament 19 that is connected to an appropriate power source (not shown) such that during tube operation, an electrical current is passed through the filament to cause electrons, designated at 20, to be emitted from the cathode by thermionic emission. Application of a high voltage differential between the anode 14 and the cathode 16 causes the electrons 20 emitted from the filament 19 to accelerate from the cathode toward a focal track 22 that is positioned on a target surface 24 of the rotating anode 14. The focal track 22 is typically composed of tungsten or a similar material having a high atomic ("high Z") number. As the electrons 20 accelerate, they gain a substantial amount of kinetic energy, and upon striking the target material on the focal track 22, some of this kinetic energy is converted into electromagnetic waves of very high frequency, i.e., x-rays 26, shown in FIG. 1.

A significant portion of the x-rays 26 produced at the anode target surface are directed through both a first window 28 positioned in the evacuated enclosure 12 and a second window 30 positioned in the outer housing 11. The x-rays 26 can then be used for a variety of purposes, according to the intended application. For instance, if the x-ray tube 10 is located within a medical x-ray imaging device, the x-rays 26 emitted from the x-ray tube are directed for penetration into an object, such as a patient's body during a medical evaluation for purposes of producing a radiographic image of a portion of the body.

In accordance with one embodiment of the present invention, the x-ray tube 10 includes an integrated fluid pump, an example of which is generally designated at 200. The integrated fluid pump 200 forms a portion of a cooling system, generally designated at 40, that is utilized to ensure proper cooling of the evacuated enclosure 12 (and the components contained therein) during tube operation. The cooling system 40, which is exemplary of many such cooling systems, includes a reservoir 42 defined by a wall 11A of the outer housing 11. Of course, the configuration shown in FIG. 1 is but one example of any one of a number x-ray tube and cooling system configurations that could be used in a manner consistent with embodiments of the present invention.

In the illustrated embodiment, during tube operation the integrated pump 200 pumps the coolant 13 from the reservoir 42 to a heat exchanger 46 via a first fluid line 44. The heat exchanger 46, which is representative of any one of a variety of heat removal devices, is used to remove thermal energy acquired by the coolant 13 as a result of heat convected from the surface of the evacuated enclosure 12 within the outer housing 11. The heat exchanger 46, therefore, removes excess heat from the coolant 13 that is forwarded by the pump 200. Following this heat removal, the coolant 13 is returned to the outer housing 11 via a port 50 and a second fluid line 48 attached to the port.

In the example shown, coolant that is introduced by the second fluid line 48 into the reservoir 42 is then circulated about the evacuated enclosure 12 to absorb heat produced during tube operation. In brief, heat that is produced by the production of the x-rays 26 is created largely in the anode region and is radiated by the anode to the exterior portions of the evacuated enclosure 12, which typically is implemented with a material that conducts the heat to its exterior surfaces. This heat can then be absorbed by the coolant 13 that circulates about the exterior of the evacuated enclosure 12. Following absorption, the coolant 13 is then removed from the reservoir 42 by action of the pump 200 and cooled by the heat exchanger 46 before recirculation back into the reservoir 42, as described above. This constant recirculation of the coolant maintains proper operating temperature of the x-ray tube 10. It is appreciated that, though the cooling system 40 depicted in FIG. 1 is one example of a cooling system for use in an x-ray tube, cooling systems that vary from that depicted herein, or that include additional or alternative components, can also be employed in connection with an integrated pump as disclosed herein.

Figure 2:
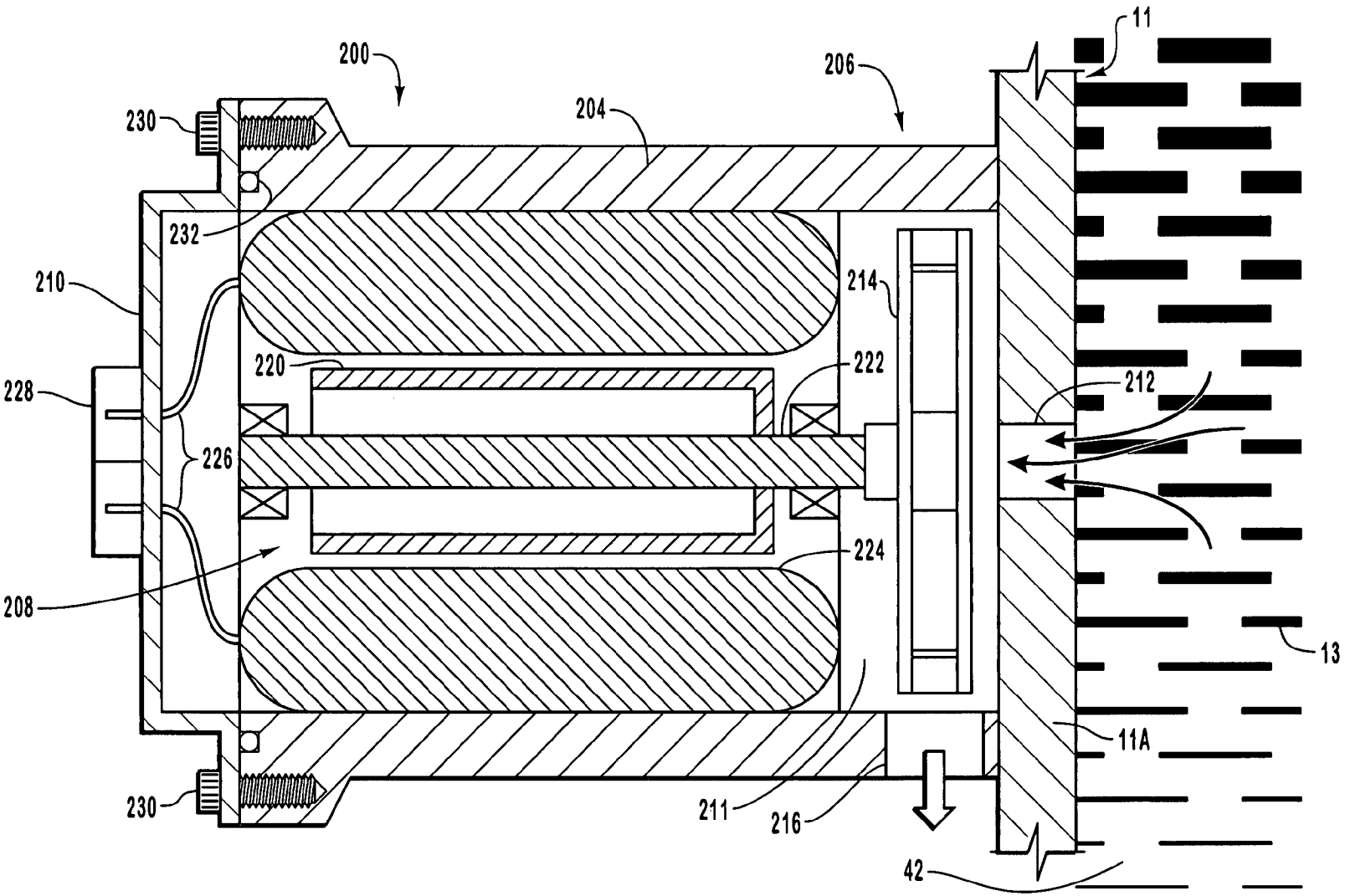
FIG. 2 is a close-up cross sectional view of the fluid pump of FIG. 1, according to one embodiment.

Reference is now made to FIG. 2, which depicts a close-up partial cross sectional view of the example fluid pump 200 shown in FIG. 1. As shown, this pump 200 includes various components: a pump body 204, a pump head 206, a motor 208, and an end plate 210, described in further detail below. In this embodiment, the pump body 204 is cylindrically shaped and houses several components of the pump 200. The pump body 204 here is manufactured from aluminum, though other materials can also be used in forming the body. In one embodiment, the pump body 204 is manufactured from an extruded aluminum piece, which is then brazed or welded to a portion of the outer housing wall 11A, as shown in FIG. 2. The attachment of the pump body 204 to the outer housing wall 11A structurally integrates the pump 200 with the outer housing 11 such that operation of the pump is dependent upon its integration with the outer housing, as will be described further below.

The pump head 206 generally includes a pump volume 211, an inlet 212, an impeller 214, and an outlet 216. In the present embodiment the pump body 204 partially defines the pump head 206; specifically, it defines a portion of the pump volume 211. The remaining portion of the pump volume 211 is defined by an exterior portion of the outer housing wall 11A, as shown in FIG. 2. The cooperation of these two components creates the cylindrically shaped pump volume 211 suitable for containing the impeller 214. This configuration simplifies design of the fluid pump, which otherwise would necessarily include a pump head cover to complete, together with the pump body, the pump volume.

Positioned as described above, the impeller 214 is rotated by the motor 208 to direct the coolant 13 by imparting a kinetic force thereto. In the present embodiment, the impeller 214 is of a closed impeller design, however, semi-open and open impeller designs can also be utilized in other embodiments. More generally, the pump 200 as described herein is a centrifugal-type pump, however in other embodiments positive displacement pumps or other types of pumps can also be used.

An inlet 212 is defined between the pump volume 211 and the reservoir 42 of the outer housing 11 in order to enable fluid flow between the reservoir and the pump volume. In accordance with the present embodiment, the inlet 212 is defined by a portion of the outer housing wall 11A, thereby integrating it with the structure of the fluid pump 200. An outlet 216 is included in the portion of the pump body 204 that defines the pump head 206 to enable fluid that is moved by the impeller to exit the pump 200. As such, a fitting, such as fitting 218 shown in FIG. 1, or other suitable structure can be attached to the outlet 216 to enable the outlet to establish fluid communication with a fluid line, such as the first fluid line 44 of FIG. 1.

The impeller 214 is rotatably driven by the motor 208, which includes a rotor 220 having a rotor shaft 222 that attaches to a central portion of the impeller. A stator 224 is included in the motor 208 to rotationally drive the rotor 220, and hence the rotor shaft 222 and impeller 214, as desired. Electrical leads 226 extend from the stator 224 and terminate at a connector 228 positioned on the end plate 210. The connector 228, which can be a standardized connector, can then electrically connect with appropriate electrical lines (not shown) to provide an electrical supply to the motor 208. The end plate 210 is attached to the pump body 204 via a plurality of screws 230, or other suitable fastener.

In operation, the motor 208, receiving a suitable electrical supply via the connector 228 and electrical leads 226, produces a rotational force that rotates the rotor 220 and rotor shaft 222. This in turn rotates the impeller 214, thereby causing coolant 13 from the reservoir 42 to be drawn into the pump volume 211 via the inlet 212. Corresponding to the rotation of the impeller 214, kinetic energy is imparted to the coolant 13 in the pump volume 211. This causes coolant 13 to be ejected from pump volume 211 via the outlet 216, which fluid can then be introduced into a fluid line, such as the first fluid line 44 of the closed circulation loop shown in FIG. 1, in order to proceed to the heat exchanger 46 for cooling before reintroduction into the outer housing reservoir 42. In this way, heat absorbed by the coolant in the reservoir 42 can be reliably removed to ensure proper operation of the x-ray tube 10.

The pump 200 shown in FIG. 2 is a submerged pump type, wherein the coolant 13 that is introduced into the pump volume 211 can also circulate through the motor 208. The flow of coolant 13 within the motor 208 assists in cooling the motor components, such as the stator 224. An O-ring 232 is interposed between the end plate 210 and the end of the pump body 204 in order to prevent any leakage from the pump 200 of coolant 13 that circulates about the motor 208. A dielectric coolant is used in this embodiment to prevent electrical problems between the motor components and the fluid. Examples of dielectric oil include Syltherm HF manufactured by the Dow Company, and Diala AX manufactured by the Shell Company. In other embodiments, partially submerged and non-submerged motors can be employed.

It is appreciated that, in other embodiments, the positions of the inlet and the outlet of the pump 200 can be reversed such that fluid is introduced from an inlet defined in the side of the pump body and ejected into the reservoir 42. In addition, various other inlet, outlet, and fluid flow configurations can be configured, suitable with the purposes of the particular application in which the pump is employed. Additionally, though it is shown receiving fluid from an area of the reservoir 42 that is adjacent thereto, the inlet 212 can alternatively include a fluid line that extends some distance into the reservoir in order to draw coolant from a particular location within the outer housing 11. Further, the fluid pump can be located at various other positions on the x-ray tube, apart from what is shown in FIG. 1. Thus, these and other modifications of the fluid pump as shown in FIGS. 1 and 2 are hereby contemplated as comprising part of embodiments of the present invention.

Inspection of FIG. 2 will reveal that the outer housing 11 of the x-ray tube 10 contributes a portion of the structure of the pump 200, as mentioned, in accordance with embodiments of the present invention. Specifically, the inlet 212 and a portion of the pump head 206 are defined by the wall 11A of the outer housing 11. So configured, the pump 200 is dependent upon the outer housing 11 to complete its structure and functionality. The advantages of such a design will be discussed in further detail below.

Note that use of the pump 200 within a closed loop cooling system, such as that shown in FIG. 1, does not limit other potential used of the fluid pump. Indeed, in other embodiments the pump 200 can form part of an open circulation system, wherein coolant is passed a single time through the outer housing reservoir, then removed by the pump and employed elsewhere in lieu of cooling and recirculation back into the reservoir. These and other modifications to the cooling system are therefore contemplated.

One advantage of the integrated pump as described in accordance with embodiments of the present invention is the facilitation of pump component replacement when change-out or remanufacturing of the pump is necessary. During the operational lifetime of an x-ray tube, various components of the pump 200 tend to wear out at a relatively rapid pace. These components include the impeller 214 and the motor 208. In contrast, various components of the pump 200, such as the pump body 204, do not significantly deteriorate over time. Thus, when remanufacturing or repair of the x-ray tube or pump occurs, only selected components of the pump typically need to be replaced. The pump 200 is designed such that those components that are apt to require more frequent replacement can be efficiently replaced without affecting other pump components. In one embodiment, this can be achieved by removing the screws 230 and end plate 210, then removing the motor 208 and impeller 214. A new motor and impeller can then be inserted into the pump body 204, the end plate 210 replaced, and the screws 230 reinserted. The pump body 204, as a result of not having experienced significant deterioration, can remain integrated with the outer housing 11, and the pump 200 can then begin a new operational lifetime. In this way, integration of the pump body with the outer housing simplifies pump component replacement by not requiring the needless removal of the pump body from the x-ray tube.

In addition, it is noted that the end plate 210 is attached to the body 204 via removable screws 230, which provides the integrated fluid pump with an advantage over other known designs, wherein the various components are welded together. In such known designs, when removal of the motor assembly, impeller, or other interior components of the pump is required, the welds must be ground down or otherwise removed in order to remove the components, after which the outer body must be re-welded, representing a significant expense in time.

Figure 3:
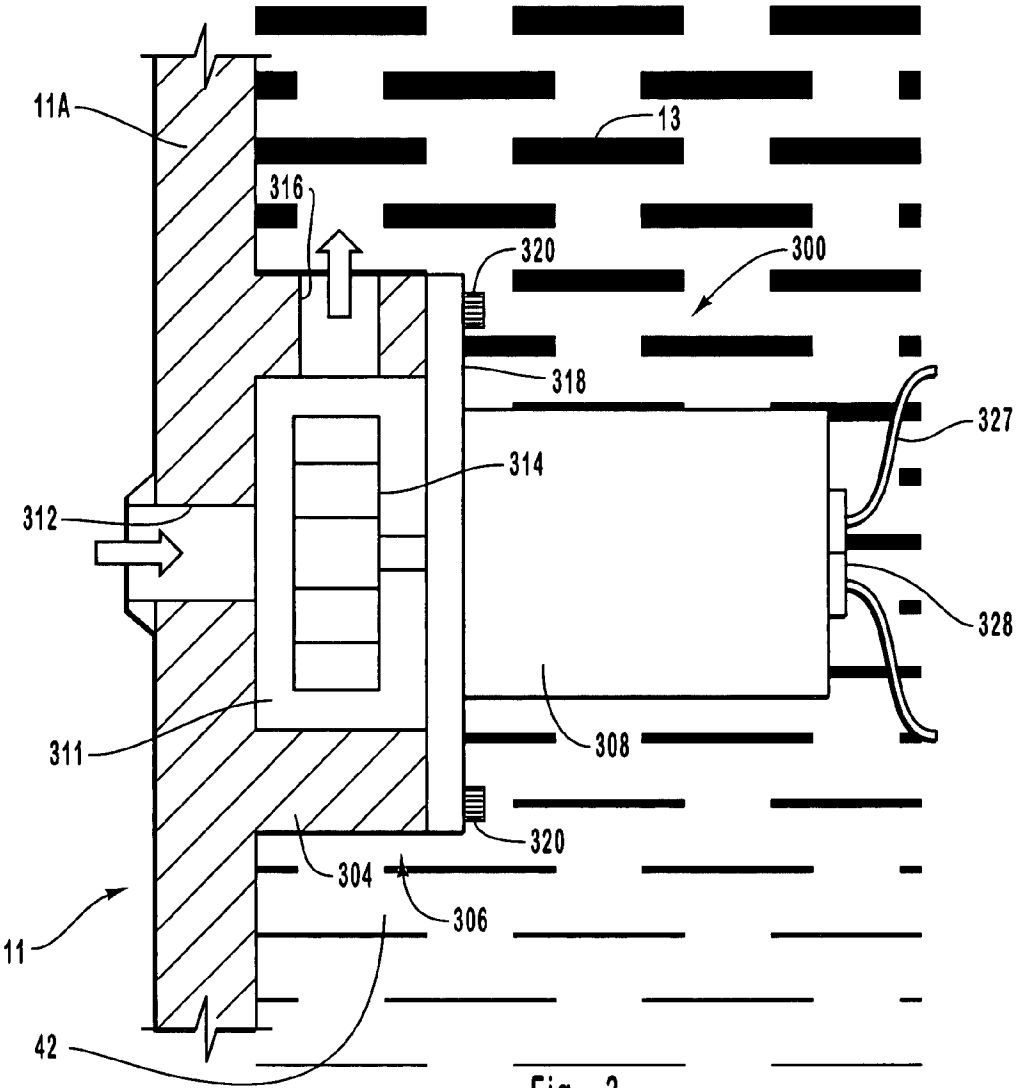
FIG. 3 is a partial cross sectional view of a fluid pump according to another embodiment.

Reference is now made to FIG. 3, which shows various features of another embodiment of the present invention. In detail, FIG. 3 shows an integrated fluid pump 300, including a body 304, a head assembly 306, and a motor 308. The pump body 304, which includes the pump head 306, is shown in FIG. 3 as being integrally formed with the outer housing 11 of the x-ray tube 10 (FIG. 1). This integration between the pump body 304 and the outer housing wall 11A can be accomplished in the present embodiment by a casting process wherein both the pump body 304 and the outer housing 11 are formed using a mold or cast into which molten aluminum or other suitable substance is poured, then hardened. In another embodiment, as was the case with the pump 200 of FIG. 2, the pump body 304 can be formed by an extrusion or other suitable process, then brazed or welded to the outer housing 11 in an appropriate location. Regardless of the technique by which the outer housing 11 and pump body 304 are formed, the structure and function of the pump 300 is integrated into the structure of the outer housing 11 in order to accomplish the aims of the present invention.

As in the previous embodiment, the pump head 306 of the pump 300 includes a pump volume 311, an inlet 312, an impeller 314, and an outlet 316, which cooperate to direct fluid through the pump 300. Also, as before, the motor 308 is attached to the impeller 314 in order to provide the necessary rotational force for the impeller. A plate 318 is interposed to mount the motor 308 to the pump body 304, and is secured using a plurality of screws 320 or other suitable fasteners. Electrical wires 327 connect to an electrical connector 328 located on an end of the motor 308 for providing an electrical supply to the motor.

In contrast to the embodiment shown in FIG. 2, the pump 300 of FIG. 3 is positioned such that it is located within the reservoir 42 of the outer housing 11. So configured, fluid can be introduced to the pump 300 from outside of the outer housing by a fluid line, similar to the first or second fluid lines 44 and 48 of FIG. 1, that attaches to the inlet 312, thereby enabling coolant 13 to enter the pump volume 311. Coolant introduced into the pump volume 311 can be ejected into the reservoir 42 via the outlet 316 by way of rotation of the impeller 314 during pump operation. Thus, in the illustrated configuration, cooled coolant 13 can be introduced via the inlet 312, which coolant is then introduced into the reservoir 42 via the outlet 316 of the pump 300. Thus, the pump 300 operates to draw coolant from a source located outside of the x-ray tube 10, such as the heat exchanger 46 in FIG. 1, and transports the coolant to the reservoir 42 of the outer housing 11 as described above. In this way, a closed loop coolant circulation is used to maintain a proper coolant temperature in the x-ray tube.

As with the previous embodiment of FIG. 2, the pump 300 is structurally integrated with the outer housing 11. In detail, the inlet 312 and a portion of the pump volume 311 are defined by the outer housing wall 11A. Also, the pump body 304 is structurally integrated with the outer housing 11 as described above such that structural completeness of the fluid pump 300 is dependent upon structural contributions from the outer housing 11, in accordance with principles of the present invention. In general, therefore, a variety of configurations can be envisioned, wherein portions of the integrated pump of the present invention are integrated with or defined by a portion of the x-ray tube 10, such as the outer housing 11.

Figure 4:
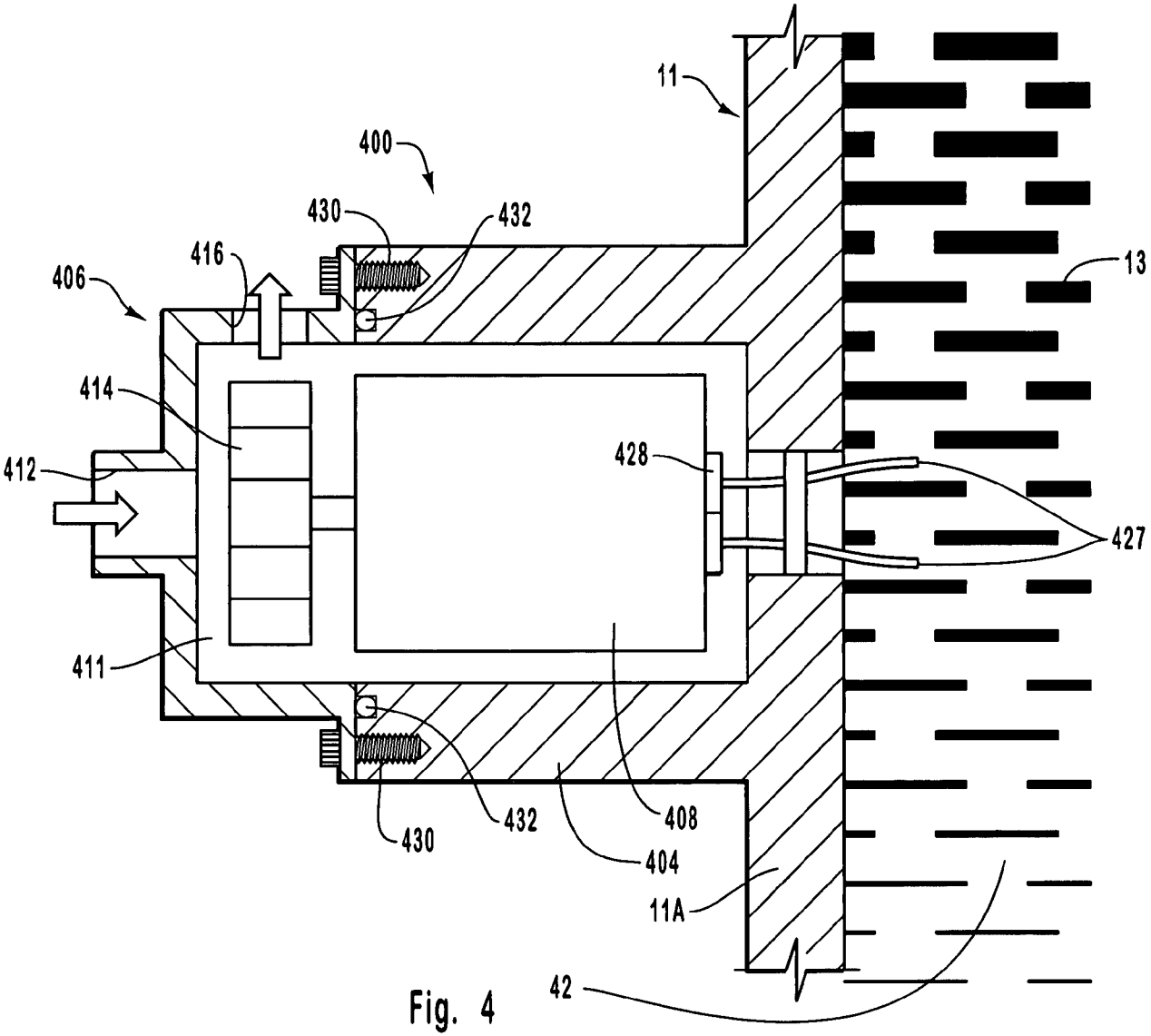
FIG. 4 is a partial cross sectional view of a fluid pump according to yet another embodiment.

Reference is now made to FIG. 4, which describes yet another embodiment of an integrated fluid pump in accordance with one embodiment of the present invention. In detail, FIG. 4 depicts an integrated fluid pump, generally designated at 400, including a pump body 404, a pump head 406, and a motor 408.

As was the case with the embodiment of FIG. 3, the pump body 404 of the pump 400 is structurally integrated with a portion of the outer housing wall 11A of the outer housing 11. As illustrated, the pump body 404 is integrally formed with the outer housing wall 11A using a casting process, as already described, or other suitable method. Thus, as before, a cylindrically round pump body 404 is formed, though in other embodiments the pump body can define other shapes as well.

The pump head 406 defines various components, including a pump volume 411, an inlet 412, and an outlet 416. An impeller 414 is positioned within the pump volume 411 and is rotatably attached to the motor 408 in order to enable its rotation. As before, electrical wires 427 are electrically connected to a connector 428 located on an end of the motor 408 in order to provide the motor with an electrical supply. The pump head 406 is attached to the pump body 404 via a plurality of screws 430 or other suitable fasteners. In addition, an O-ring 432 is interposed between the pump body 404 and the pump head 406 in order to prevent leakage of coolant from the pump 400.

As shown, the pump 400 is located outside of the reservoir 42, in contrast to the embodiment shown in FIG. 3. In addition, though the electrical wires 427 are shown entering the reservoir 42, the electrical connectivity of the motor 408 can be configured such that electrical wires enter from another location to the exterior of the reservoir 42. In the illustrated embodiment, the electrical connector 428 is positioned as shown to enable the electrical wires 427 to pass through the outer housing wall 11A and into the reservoir using the same feed-through as that used by electrical leads for supplying an electrical signal to a stator located within the outer housing 11.

As before, the inlet 412 and outlet 416 are each configured to couple with fluid lilies, such as first and second fluid lines 44 and 48 shown in FIG. 1, in order to provide fluid flow into and out of the pump 400, as in previous embodiments. The fluid lines that couple with the inlet 412 and outlet 416 could be configured in a variety of ways in order to establish a closed circulation loop between the reservoir 42 and other components of a cooling system, to maintain a proper coolant temperature.

Figure 5:
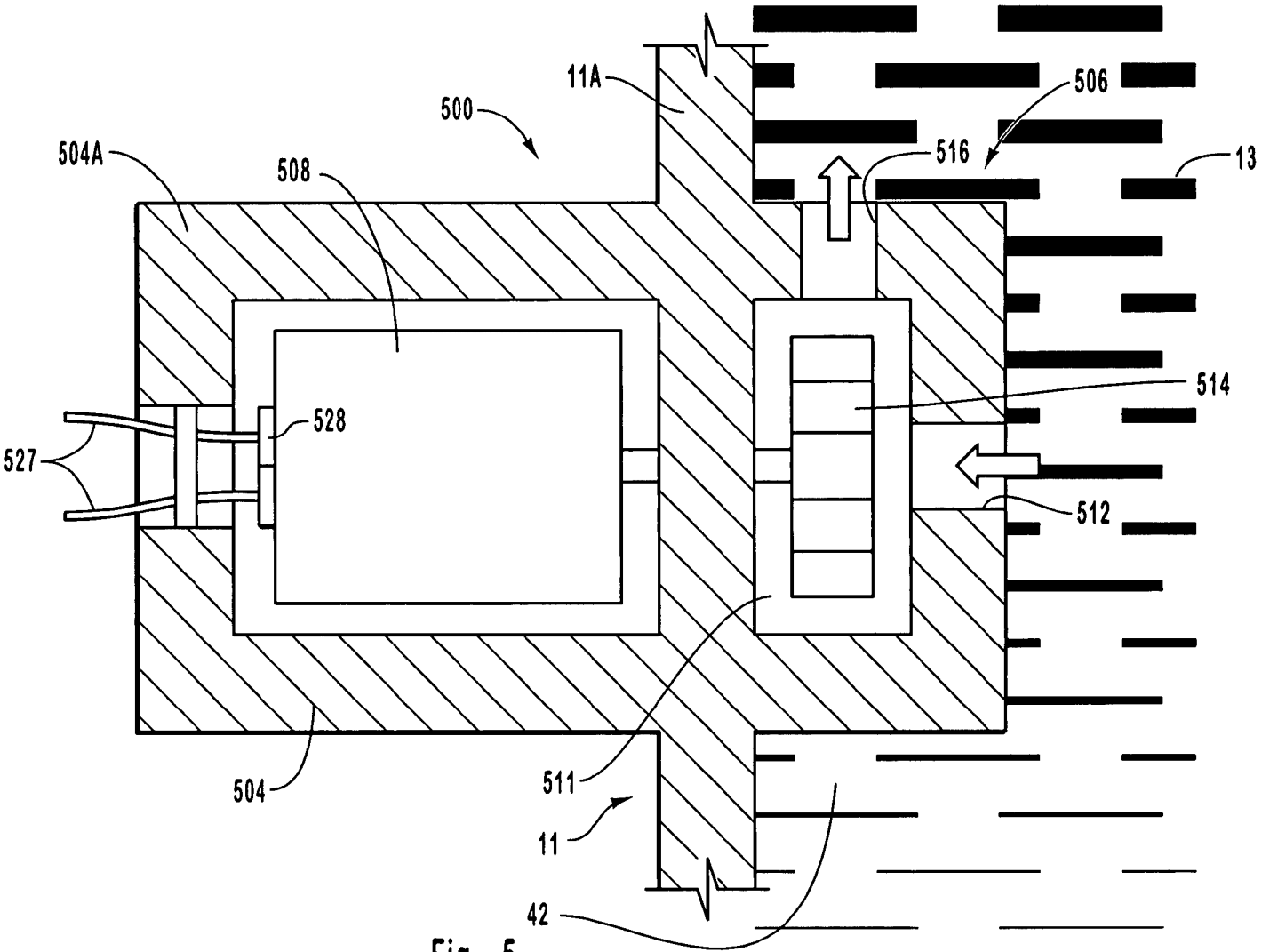
FIG. 5 is a partial cross sectional view of a fluid pump according to still another embodiment.

Reference is now made to FIG. 5, showing yet another embodiment of the present invention. In detail, FIG. 5 shows an integrated fluid pump, generally designated at 500, including a pump body 504, a pump head 506, and a motor 508. The pump body 504 is integrated with the outer housing wall 11A, as in previous embodiments, such that the outer housing 11 defines a portion of the pump body. Further, the pump body 504 is configured such that it extends both outwardly and inwardly with respect to the outer housing wall 11A. Specifically, a body portion 504A extends to the exterior of the outer housing 11 and defines a cylindrical volume in which the motor 508 is disposed. In addition, the pump head 506 defined by the body 504 extends into the reservoir 42.

The above pump body structure can be manufactured as has been previously described in connection with the other embodiments, i.e., by integrally casting or molding the pump body 504 with the outer housing 11, or by brazing the pump body to the outer housing wall 11A. In either case, the outer housing 11 supplies a portion of the structure of the pump 500, in accordance with the principles of the present invention.

In detail, the outer housing wall 11A defines a portion of the volume in which the motor 508 is disposed. The outer housing wall also defines a portion of a pump volume 511 of the pump head 506. Again, the general shape of the pump body 504 is cylindrical so as to define an appropriate volume in which the motor 508 can be placed, as well as defining a cylindrical shape for the pump volume 511. However, in other embodiments the pump body can be configured so as to define various different shapes for the volume in which the motor is placed, as well as for the pump volume. As before, electrical wires 527 are used to electrically connect the motor 508 to an appropriate power source via a connector 528. In this configuration, electrical wires are provided from outside of the x-ray tube 10.

The pump head 506 includes, in addition to the pump volume 511, an inlet 512, an impeller 514, and an outlet 516. The impeller 514, rotatably driven by the motor 508, is employed, as in previous embodiments, to circulate coolant 13 by receiving the fluid via the inlet 512 and ejecting it from the outlet 516. However, in contrast to the previous embodiments, the pump 500 circulates the coolant 13 solely within the reservoir 42, and therefore does not employ fluid lines or a heat exchanger. This configuration may be desirable when stagnation of the coolant in certain areas of the outer housing 11 is problematic.

The present invention may be embodied in other specific forms without departing from its spirit or essential characteristics. The described embodiments are to be considered in all respects only as illustrative, not restrictive. The scope of the invention is, therefore, indicated by the appended claims rather than by the foregoing description. All changes that come within the meaning and range of equivalency of the claims are to be embraced within their scope.

What is claimed is:

1. An x-ray tube, comprising:

an evacuated enclosure containing an electron source and an anode positioned to receive electrons produced by the electron source;

a housing within which the evacuated enclosure is at least partially disposed; and a fluid pump in fluid communication with the housing, the fluid pump comprising:

an impeller;

a motor connected to the impeller;

a pump head; and a pump body, the pump body and a wall of the housing substantially defining a first cavity within which the motor is substantially disposed, and the pump head and the wall of the housing cooperating to substantially define a second cavity within which the impeller is substantially disposed, the second cavity having inlet and outlet fluid connections in fluid communication with the housing.

2. An x-ray tube as defined in claim 1, wherein the pump body comprises aluminum.

3. An x-ray tube as defined in claim 1, wherein the pump body and the housing collectively comprise a casting.

4. The x-ray tube as recited in claim 1, wherein the pump body is substantially disposed outside the housing, and the pump head is substantially disposed within the housing.

5. The x-ray tube as recited in claim 1, wherein the pump body is integral with the wall of the housing.

6. The x-ray tube as recited in claim 1, wherein the pump head is integral with the wall of the housing.

7. An x-ray tube, comprising:

an evacuated enclosure containing an electron source and an anode positioned to receive electrons produced by the electron source;

a housing within which the evacuated enclosure is at least partially disposed; and a fluid pump configured for fluid communication with the housing, the fluid pump comprising:

an impeller;

a motor connected to the impeller;

a pump head; and a pump body to which the pump head is attached, the pump body and a wall of the housing cooperating to substantially define a cavity within which the motor and impeller are substantially disposed, the cavity having fluid inlet and outlet connections that are external to the housing.

8. The x-ray tube as recited in claim 7, wherein the fluid pump comprises a submerged pump.

9. The x-ray tube as recited in claim 7, wherein the pump body is integral with the housing.

10. The x-ray tube as recited in claim 7, wherein the pump head is removably attached to the pump body.

11. The x-ray tube as recited in claim 7, wherein the fluid pump is located substantially outside of the housing.

* * * * *